United States Patent [19]

Reeves et al.

[11] 4,366,963

[45] Jan. 4, 1983

[54] CONVERTIBLE INFLATED PLAY VEHICLE

[75] Inventors: Lloyd Reeves; L. W. Sorensen, both of Lethbridge, Canada

[73] Assignee: Funsafe (Canada) Ltd., Lethbridge, Canada

[21] Appl. No.: 53,823

[22] Filed: Jul. 2, 1979

[30] Foreign Application Priority Data

Jun. 26, 1979 [CA] Canada ..... 330608

[51] Int. Cl.[3] ..... B62B 15/00

[52] U.S. Cl. ..... 280/12 B; 441/67; 441/40; 272/1 B

[58] Field of Search ..... 280/7.1, 12 B, 12 H; 9/2 A, 6 R, 6 P, 11 A, 310 R, 310 F, 310 G; 272/1 B, 130

[56] References Cited

U.S. PATENT DOCUMENTS

| | | | |
|---|---|---|---|
| 2,399,494 | 4/1946 | Manson et al. | 9/11 A |
| 2,562,080 | 7/1951 | Barnes | 272/1 B |
| 2,720,664 | 10/1955 | Gray | 9/11 A |
| 2,735,690 | 2/1956 | Paden et al. | 280/12 B |
| 2,761,155 | 9/1956 | Headley | 272/1 B |
| 3,021,536 | 2/1962 | Haggerty | 9/11 A |
| 3,080,584 | 3/1963 | Brown | 272/1 B |
| 3,155,992 | 11/1964 | Shewmake et al. | 9/11 A |
| 3,180,639 | 4/1965 | Cotler et al. | 9/11 A X |
| 3,581,328 | 6/1971 | Smith | 280/12 B X |
| 3,628,206 | 12/1971 | Mecham | 9/11 A |
| 3,781,933 | 1/1974 | Soter | 9/11 A |
| 3,871,042 | 3/1975 | Farmer | 280/12 B X |
| 4,160,299 | 7/1979 | Hilbern | 280/12 B X |

FOREIGN PATENT DOCUMENTS 690836 7/1964 Canada .

*Primary Examiner*—Joseph F. Peters, Jr.
*Assistant Examiner*—Michael Mar
*Attorney, Agent, or Firm*—Berman, Aisenberg & Platt

[57] ABSTRACT

A convertible play vehicle comprising an inflatable flotation ring encircling an integral reinforced, load-bearing platform that lies mid-way of the height of the flotation ring and has spaced openings near the circumference thereof that may serve as hand grips and a separable sled portion releasably secured on the underside of the inflatable ring by straps that are attached to the sled and extend over the ring, passing twice through the ring platform via the circumferential openings therein. The inflatable ring may be formed of two circular disks of rubber-like material vulcanized together at their outer circumference and at a concentric circle spaced inwardly therefrom to provide an inflatable endless tube therebetween. The sled may be of fiberglass or plastic with its ends rounded up to accomodate the inflated ring and provided with integral strap-passing eyelets on its upper side and parallel runners extending longitudinally on the underside.

9 Claims, 4 Drawing Figures

CONVERTIBLE INFLATED PLAY VEHICLE

BACKGROUND OF THE INVENTION

This invention relates to improvements in a child's play vehicle and appertains particularly to a conveyance incorporating an inflatable tube that is convertible from a flotation unit to a sled.

SUMMARY OF THE INVENTION

Life preservers in the form of inflated tubes and other buoyant rings have long been in use, often being provided with a continuous line caught in loops to the ring's circumference to afford an easy grip for a person using the same. Frequently children use such flotation rings and used car and tractor tubes when playing in the water and for sliding on hills in the winter. For sliding in winter and for draging on land, it has been known to permanently secure a solid base to an inflated ring to protect it, but not without reducing its buoyancy and detracting from the safety of the flexible inflated tube.

Flotation rings are exemplified in U.S. Pat. Nos. 3,021,536; 3,080,584; 2,399,494 and 3,781,933 while an inflatable two-part sled for rescue work is seen in Canadian Pat. No. 690,836 and on inflatable tube with rigid ground engaging bottom is disclosed in U.S. Pat. Nos. 2,720,664 and 3,628,206.

It is an object of this invention to provide a child's play vehicle incorporating an inflatable ring with a vented load-bearing central platform that may be safely used as a flotation conveyance and a separable sled portion releasably secured on the underside of said inflated ring for use when sliding on snow or draging the assembled vehicle on land.

A further object of the invention is to provide a flotation ring comprising two superimposed circles of rubber-like material vulcanized together of their outer circumference and at a concentric circle spaced inwardly therefrom to provide an inflatable endless tube between such spaced outer and inner vulcanized rings and an integral two-ply platform within said vulcanized inner circle.

A further object of the invention is to provide a flotation ring with a loosely looped hand grip line strongly secured at spaced intervals to the outer circumference of the ring midway of its height.

A further object of the invention is to provide a child's flotation ring having an integral reinforced central platform with appertures therein that may serve as hand grips for the user.

A further object is to provide a separable sled portion of plastic or the like that may be easily and quickly strapped on or removed from the ring, being rounded up at one or both ends and provided with a tow rope.

To the accomplishment of these and related objects as shall become apparent as the description proceeds the invention resides in the construction, combination and arrangement of parts as shall be hereinafter more fully explained, illustrated in the accompanying drawings and pointed out in the claims hereunto appended.

BRIEF DESCRIPTION OF THE DRAWINGS

In the drawings forming a part of this disclosure and wherein like characters indicate like parts throughout the several figures.

DETAILED DESCRIPTION OF THE INVENTION

Figure 1:
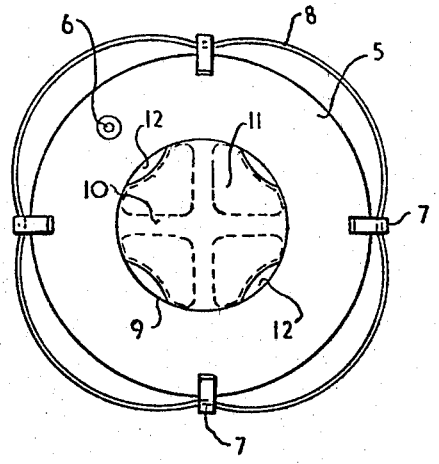
FIG. 1 is a plan view of the inflatable flotation ring.

For the present convertible play vehicle, an inflatable tube 5 is used having a suitable compression type self-closing air inlet valve 6 extending from its upper side. At spaced intervals about its outer circumference special sturdy bifurcated rubber brackets 7 straddle the tube and are vulcanized thereto each having a line passing opening therethrough to serve as grommets for a loosely looped hand grip line 8 that encircles the tube. The tube 5 is of one ply rubber and is here shown as formed of two flat circular disks vulcanized about the perimeter with or without a reinforcing rib and also vulcanized around a concentric circle spaced inwardly therefrom and designated by the numeral 9 to provide the inner side of the inflated tube. Within the inner vulcanized circle 9 the two layers of the rubber disks are united and strengthened by a suitable cobweb or reticulated vulcanized pattern 10 preferably reaching to the said inner vulcanized circle 9 to constitute a reinforced central platform 11. The stability of this inflated flotation conveyance is improved by having vents 12 extending through this reinforced two-ply platform, allowing the unit to float lower in the water and avoiding entrapment of a bubble of air under the platform. As seen in FIG. 1 these vents are four in number and located in close proximity to the vulcanized circle 9 that defines the circumference of the platform 11 being usable also as hand grips for the passenger or user of the flotation unit, in addition to the hand grip line 8. Formed thus, the integral reinforced two-ply platform is disposed midway of the height of the inflated tube.

With limited success inflated tube have been used for sliding on snow and draging on land where they sustain excessive wear and frequent destruction. Where a solid or rigid bottom has been permanently attached to a float ring it has reduced the buoyancy of the ring and its hard solid composition has been a cause of injury.

Figure 2:
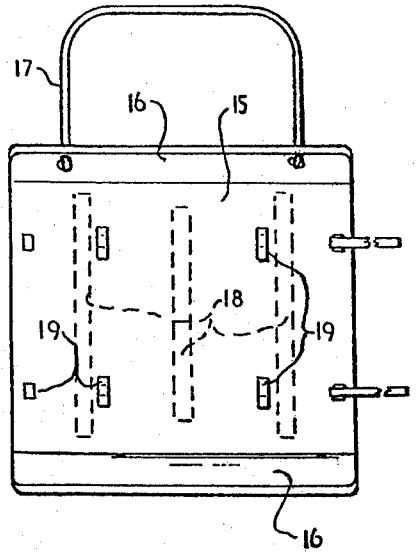
FIG. 2 is a plan view of the separable sled.
Figure 3:
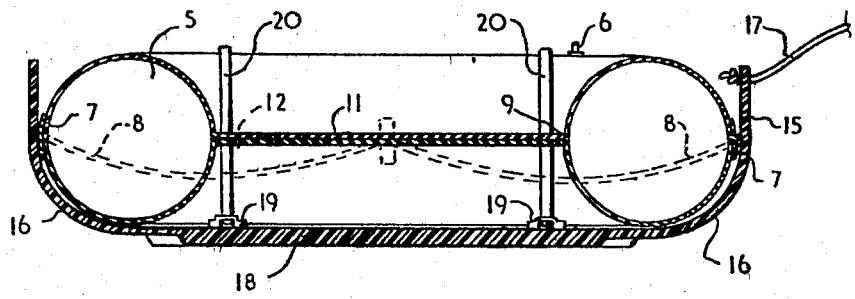
FIG. 3 is a vertical longitudinal section of the assembled land vehicle.
Figure 4:
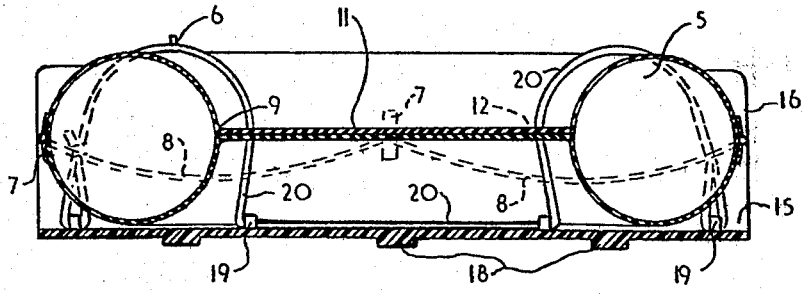
FIG. 4 is a similar vertical transverse section.

In the present case a separate sled portion 15 is available for removable attachment to the inflatable tube 5 for use on land being here shown in plan view in FIG. 2 as substantially square and of a size to conveniently receive the inflated tube 5 superimposed thereon. Made of suitable lightweight material such as fiberglass or molded plastic or the like, the ends 16—one or both—are round up in an arc similar to that of a cross-section of the tube 5, the front end being provided with a tow line 17. Parallel elongated runners 18 extending in a direction from front to rear occur on the underside of the sled 15 and may be formed integral therewith. Preferably formed integral with the molded sled body 15 are also the loops and/or eyelets for the tube-securing straps 20 that rise from the upper side of the sled body 15 at suitable locations. As here disclosed the integral strap eyelets or bridges 19 are arranged in two longitudinally spaced parallel transverse lines of four eyelets each with the end eyelet of each row being located near the opposite longitudinal sides of the sled. To attach the sled portion 15, a strap 20 is secured by one end to the outermost eyelet 19, passed over the tube 5, under the second eyelet 19, across the intervening space and under the third eyelet, over the tube 5 and tied to the last eyelet in the row. A second strap 20 is similarly secured in place being threaded through the second row of eyelets 19, overlaping the tube 5 in the same way. It will be noted that the tie straps 20 each pass twice through the reinforced platform 11, via the vents 12.

If desired the arrangement of the transverse rows of eyelets 19 may be varied to allow straps 20 to pass over the tube 5 in a more direct radial line. In this case it would mean moving the end eyelets of the front row forwardly and the end eyelets of the back row rearwardly.

From the foregoing description taken in conjunction with the accompanying drawings of a preferred form of the convertible play vehicle, it will be apparent to those skilled in the art to which this invention relates that this embodiment is susceptible to modification, variation and change without departing from the proper scope or fair meaning of the appended claims.

We claim as our invention:

1. A play vehicle comprising: a flotation unit comprising two superimposed circular discs of rubber-like material vulcanized together at their circumferences, forming an outer vulcanized circular portion, and vulcanized at an inwardly spaced circular portion of said disks, concentric with said outer vulcanized circular portion, and forming an inner vulcanized circular portion to provide an inflatable endless tube between said outer and inner vulcanized circular portions, having an integral two-ply platform disposed midway of the height of the endless tube when said tube is inflated, and within said vulcanized inner circular portion, said platform being stretched taut when said endless tube is inflated, and a sled portion releasably secured across the underside of said endless tube.

2. The play vehicle according to claim 1, wherein the integral two-ply platform has four openings therethrough that vent the area covered thereby, said openings being equally spaced about the circumference of the platform in close proximity to the inner vulcanized circular portion.

3. The play vehicle according to claim 1, wherein the integral two-ply platform is reinforced by a suitable vulcanized pattern joining the two rubber-like layers together, said vulcanizing pattern extending to the inner vulcanized circular portion.

4. The play vehicle according to claim 2, wherein the sled portion is secured to the flotation unit by straps fastened to the sled portion that extend over the inflated tube and under the platform passing through said platform openings.

5. A convertable play vehicle according to claim 4, wherein the sled portion has two separated rows of spaced eyelets with strap-passing openings therethrough, the eyelets rising above the upper surface of the sled portion and being formed integrally therewith.

6. A convertible play vehicle according to claim 2, wherein the strap-passing eyelets are arranged in two transversely extending rows of four eyelets each, with the end eyelet of each row being located near the opposite longitudinal sides of the sled.

7. A convertible play vehicle according to claim 6, wherein the sled portion is releasably secured to the flotation unit by a pair of longitudinally separated transversely disposed straps each attached at one end to an outer eyelet, passed over the inflated tube, down through a platform opening and under a second eyelet then part way across the sled portion and through a third eyelet, thence upwards through a platform opening and then again over the tube and finally secured to an outer eyelet at the opposite side of the sled portion.

8. A convertible play vehicle according to claim 1, wherein said sled portion is substantially rectangular of a size to conveniently receive the inflated tube of the flotation unit and with at least one rounded up in an arc similar to that of the cross-section of the inflated tube.

9. A convertible play vehicle according to claim 8, wherein said sled portion has parallel elongated runners on its underside extending in a direction from front to rear.

* * * * *